US005718288A

United States Patent [19]

Bertet et al.

[11] Patent Number: 5,718,288

[45] Date of Patent: Feb. 17, 1998

[54] METHOD OF CEMENTING DEFORMABLE CASING INSIDE A BOREHOLE OR A CONDUIT

[75] Inventors: Eric Bertet, Olivet; Jean-Marie Gueguen, Maisons-Laffitte; Jean-Louis Saltel, Le Rheu; Frédéric Signori, Chatillon/Seiche, all of France

[73] Assignee: Drillflex, France

[21] Appl. No.: 530,367

[22] PCT Filed: Mar. 22, 1994

[86] PCT No.: PCT/FR94/00310

§ 371 Date: Jan. 11, 1996

§ 102(e) Date: Jan. 11, 1996

[87] PCT Pub. No.: WO94/21887

PCT Pub. Date: Sep. 29, 1994

[30] Foreign Application Priority Data

Mar. 25, 1993 [FR] France ..... 93 03638

[51] Int. Cl.[6] ..... E21B 33/14; E21B 33/127

[52] U.S. Cl. ..... 166/287; 166/177.4; 166/184; 166/187; 166/288; 166/290

[58] Field of Search ..... 166/131, 133, 166/177.4, 184, 187, 188, 277, 285, 287, 288, 290

[56] References Cited

U.S. PATENT DOCUMENTS

| | | | |
|---|---|---|---|
| 3,477,506 | 11/1969 | Malone | 166/277 X |
| 3,493,045 | 2/1970 | Bassani | 166/187 |
| 3,527,299 | 9/1970 | Lewis | 166/184 |
| 3,958,637 | 5/1976 | Cobbs | 166/287 |
| 4,133,386 | 1/1979 | Knox | 166/285 |
| 5,024,273 | 6/1991 | Coone et al. | 166/289 |
| 5,318,122 | 6/1994 | Murray et al. | 166/384 X |
| 5,337,823 | 8/1994 | Nobileau | 166/277 |
| 5,346,007 | 9/1994 | Dillon et al. | 166/285 X |
| 5,454,419 | 10/1995 | Vioedman | 166/277 |

FOREIGN PATENT DOCUMENTS

| | | |
|---|---|---|
| 0 190 529 | 12/1985 | European Pat. Off. . |
| 2 662 207 | 5/1990 | France . |
| WO-91/18180 | 11/1991 | WIPO . |

*Primary Examiner*—George A. Suchfield

*Attorney, Agent, or Firm*—Blakely Sokoloff Taylor & Zafman

[57] ABSTRACT

A casing is cemented within a well bore (P) or pipe by means of a radially expandable tubular preform (1). For this purpose, a) folded preform (1) is inserted into the well (P) or pipe down to the required level; b) the well is sealed off at the bottom of the preform (10 by means of an inflatable hydraulic retainer (4); c) a curable fluid cement is injected onto the retainer so that it surrounds the lower portion of the preform; d) the preform is gradually unfolded from the top towards the bottom to press the cement against the wall of the well or pipe along the full length of the preform; e) the preform is cured to form a casing while the cement is allowed to set; and f) the retainer (4) is deflated and withdrawn from the well or pipe.

6 Claims, 6 Drawing Sheets

S
20
P
21
22
2
10
1
11
3
4
Z
F
L1
L2
9
85

1'
100
102
11
101
2
3
4
K 10
1'
C
11
40
K
L2

20
L3
22
10
1'
L1
11
L2
h
23

K
22
10'
2
1'
23
P
10
101
100
102
11
3
4
r
L1
81
320
70
7
9'
860
9
86
40

60'
82
87
52
830
9
50

L1, L2
60
85
53
850
830
50
5
35
89
890
40

L
2
60
3
87
85
53
890
40
810
81
830
50
5
35
51
80
89
88

11
60
82
87
85
850
40
4
32
860

METHOD OF CEMENTING DEFORMABLE CASING INSIDE A BOREHOLE OR A CONDUIT

The present invention relates to a method of cementing casing inside a borehole or a conduit. It also relates to a cementing device for implementing the method.

BACKGROUND OF THE INVENTION

The invention is particularly applicable to boreholes, especially in the oil industry. Although the following description relates to a vertical well, the invention may naturally also be implemented in wells that are not vertical, but that are deviated or even horizontal. It is also applicable to conduits, e.g. oil or gas pipelines, for the purpose of repairing them by installing an internal lining.

DESCRIPTION OF THE PRIOR ART

In the field of drilling for oil, a casing—often referred to [in French] by the English word "casing"—is a cylindrical pipe of rigid material designed to be put into place inside the well. It is fixed by means of cement, commonly referred to as "slurry". The presence of casing makes it possible to have a well that is cylindrical, of well-defined diameter, and with a rigid wall, thereby making it possible to pass various tools and elements required for operating the well.

At present, casing is cemented upwards from the bottom of the casing by injecting cement into the annular space between the casing and the well. The cement is injected from the surface via the inside of the casing (the slug method) or via the drilling string (a cementing techique commonly designated [in French] by the English term "innerstring").

Unfortunately, the principle on which that method is based, i.e. injecting and then moving a volume of slurry, prevents the slurry being put into place under satisfactory conditions when the available annular gap is very small or even missing, as happens when the outside diameter of the casing is close to the diameter of the well.

Casings have recently been proposed which are obtained from a tubular preform which is deformable by being expanded radially from a "folded" first state in which its maximum transverse dimension is considerably smaller than the diameter of the well, to an "unfolded" second state in which it is cylindrical in shape and has a diameter that is slightly smaller than that of the well, the preform being settable on site (after radial expansion) in order to constitute the casing.

Casings of that kind, and their method of installation, are described in documents FR-A-2 662 207 and FR-A-2 668 241, in particular.

SUMMARY OF THE INVENTION

The object of the present invention is to provide a method and a device for cementing that kind of casing, and enabling cementing to be performed under satisfactory conditions, even if the annular space available for the cement is small.

The method of the invention achieves this object by the fact that the method comprises the following steps:

a) the preform in the folded state is inserted into the well or into the conduit, and it is lowered down to the desired level;

b) the well is closed at the bottom of the preform by inflating in said zone a hydraulically deformable closure member (a closure member of the kind commonly referred to in the oil industry by the English term "packer");

c) a cement that is fluid and settable is injected above the closure member so as to surround the bottom portion of the preform, with the volume of said cement corresponding substantially to the volume required for cementing the casing in the well or in the conduit;

d) the preform is deformed to cause it to take up its unfolded state, said deformation taking place progressively from the bottom upwards, so that the cement is displaced little by little along the annular space between the preform and the wall of the well or of the conduit, along the entire height of the preform;

e) the preform is caused to set so as to obtain the casing, and the cement is allowed to set; and f) the closure member is deflated and withdrawn from the well or the conduit.

In a preferred implementation of the invention, said closure member is inflated from the surface by means of a hydraulic fluid which is delivered by a tube that passes longitudinally right through the preform.

Also, in a certain number of non-limiting additional characteristics of the invention:

after the cement has been injected in above step c), a non-setting other fluid—a "flush fluid"—of density greater than that of the cement is injected so as to occupy the space extending between the closure member and the bottom end of the preform;

the cement, and optionally the flush fluid, are delivered from the surface via the same tube as is used for inflating the closure member, passing via a distributor jacket mounted at the end of the tube which carries said closure member;

when the method is implemented using a preform whose wall sets by polymerizing when heat is applied thereto, the preform is caused to expand radially and to set by means of a hot fluid which is delivered from the surface via said tube, and via said distributor jacket; and after step d) a fluid is injected into the zone situated above the top end of the preform to eliminate any excess cement that may be present in said zone (and to prevent it from setting).

The device for cementing casing by implementing the above-described method and which likewise forms a part of the present invention comprises a fluid feed tube passing right through the preform and having its bottom end connected to an inflatable hydraulic closure member.

In a preferred embodiment, the device is provided with a fluid distributor jacket into which the bottom end of said tube opens out.

Advantageously, said distributor jacket constitutes a multi-port valve enabling the fluid feed tube to be caused to communicate selectively with the inside of the closure member, with the outside, and with the inside of the preform.

In one possible embodiment, the distributor jacket possesses pressure chambers having outlets closable by balls that are put into place, in operation, via the fluid feed tube.

In an advantageous embodiment, the fluid feed tube is provided with a valve situated above the top end of the preform, said valve serving to degrade the excess cement, as mentioned above.

Other characteristics and advantages of the invention appear from the description and the accompanying drawings which show a preferred embodiment.

DESCRIPTION OF THE PREFERRED EMBODIMENTS

Figure 1:
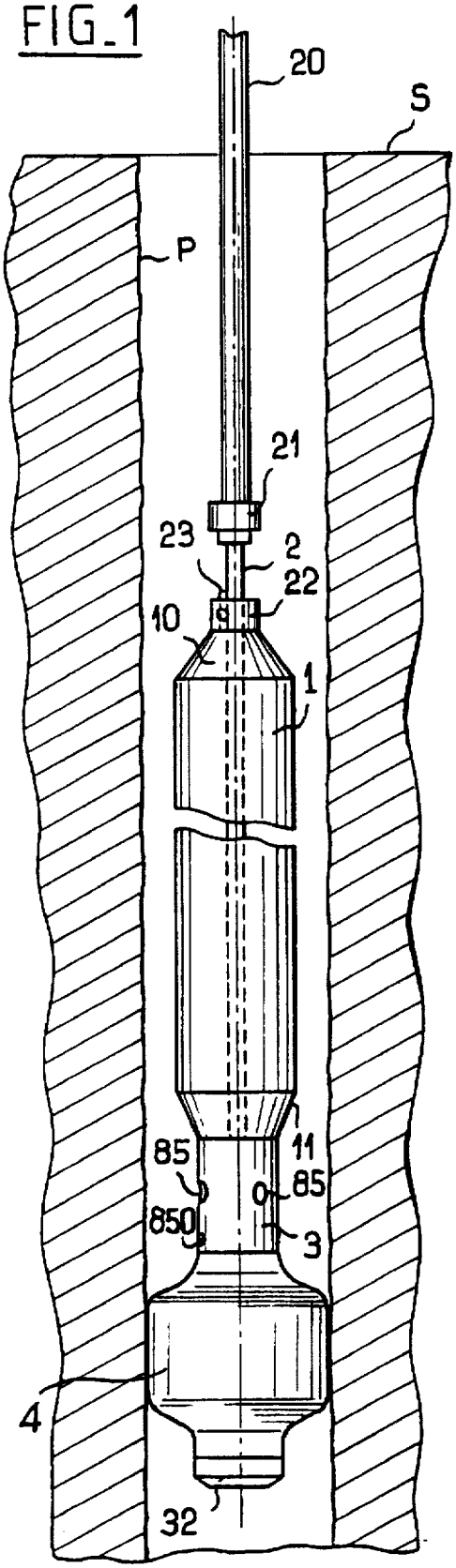
FIG. 1 is a diagrammatic overall view of the device when inserted inside a borehole.

In FIG. 1, reference S designates the surface of the ground, and reference P designates the wall of a borehole, that is approximately cylindrical in shape and that has a vertical axis.

The cementing device shown in the figure is located inside the well and essentially comprises a deformable tubular preform 1 carried by a tube 2 which passes right through it, a distributor jacket 3 disposed at the bottom of the preform, and an inflatable hydraulic closure member 4 disposed at the bottom of the jacket 3.

The assembly is suspended from pipework 20, which pipework may, for example, be in the form of a flexible hose paid out from a hose-reel carried by apparatus situated on the surface.

Reference 21 designates a coupling element between the pipework 20 and the tube 2, and reference 22 designates a connection sleeve between the tube 2 and the top end portion of the preform. The sleeve 22 is provided with a rated discharge valve 23 (a ball valve), whose function is to put the inside of the preform into communication with the outside when the pressure obtaining inside the preform exceeds a predetermined threshold, as explained below.

By way of example, the preform 1 may be of the type constituting the subject matter of above-mentioned patent application FR-A-2 668 241. It is folded up in the longitudinal direction so that while in this folded state, as shown in FIG. 1, it occupies space that is very considerably smaller than the diameter of the well. In contrast, when in the unfolded state, as can be seen in particular in FIGS. 3D and 3E, it is cylindrical in shape with a diameter that is little smaller than that of the well.

Figures 3D, 3E, 4:
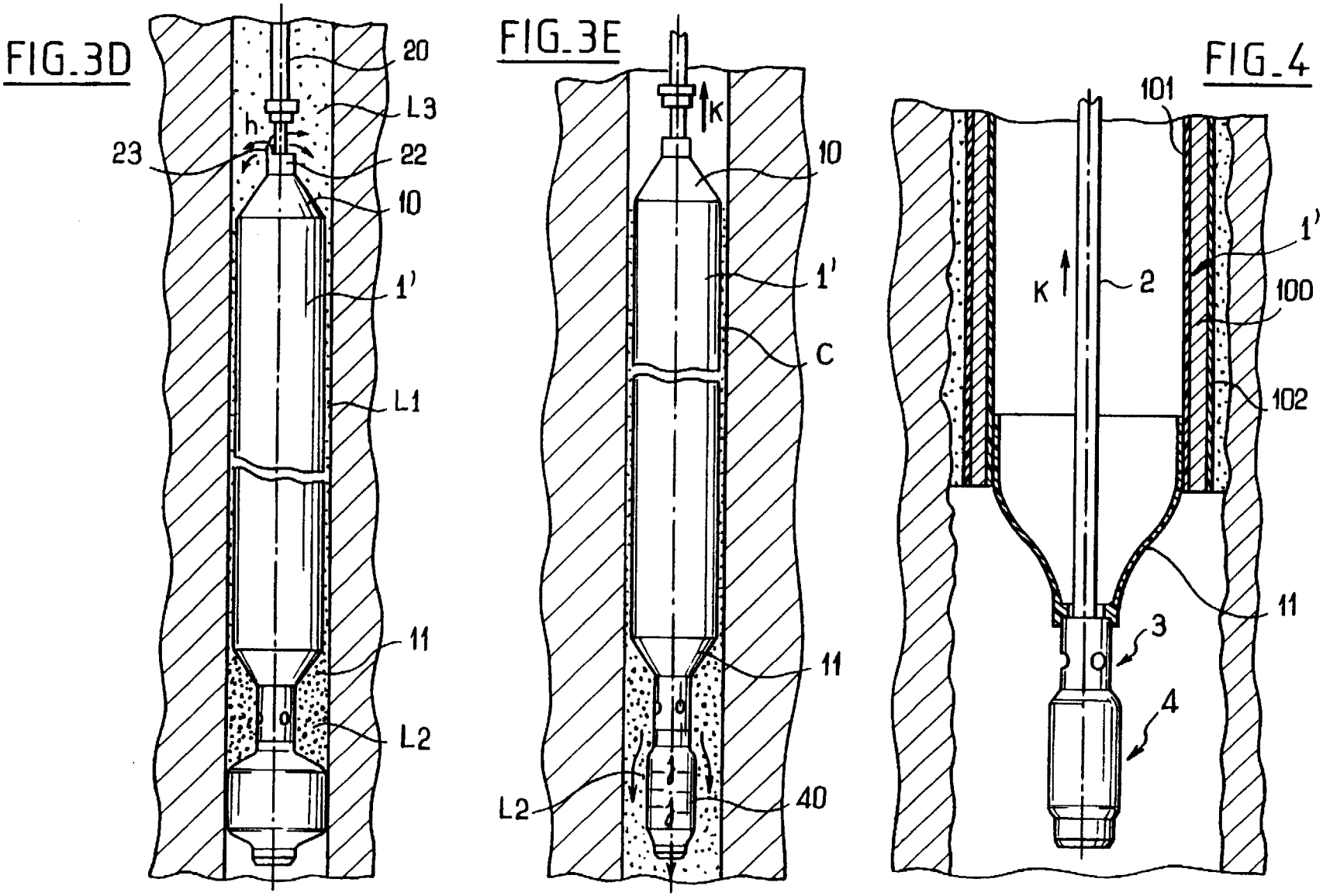
FIGS. 4 and 4A are views showing how the distributor jacket (and the hydraulic closure member) are attached to the bottom portion of the casing, respectively before and during their removal from the casing.
Figures 4A, 5, 6D, 6E:
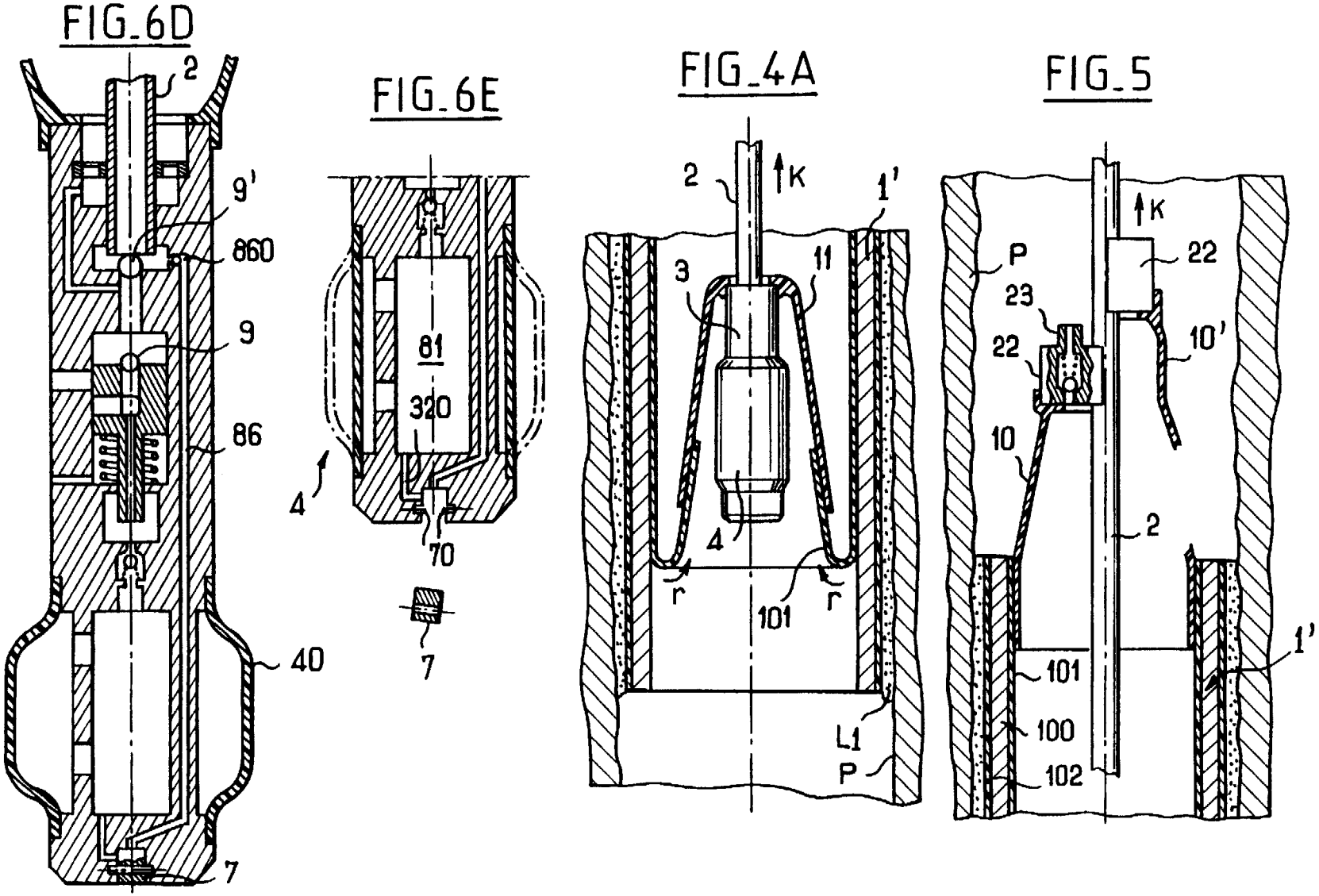
FIG. 5 is a view similar to FIG. 4, showing the means for connecting the, fluid feed tube with the top portion of the casing, with the left and right half-views of this figure corresponding to respective states of said means before and after removal of the tube.
FIGS. 6, 6A, 6B, 6C, 6D, and 6E are views similar to FIG. 2, on a smaller scale, and showing the distributor head during the main steps of implementing the method.

As can be seen in FIGS. 4 and 5, the wall of the preform is made up of a core 100 sandwiched between an inside skin 101 and an outside skin 102. The core 100 is made of a material comprising filaments impregnated in a thermosetting resin. The skins 101 and 102 may, for example, be thin synthetic fabrics.

At its top end, the preform 1 is attached to the sleeve 22 by means of a flexible tapering portion 10, and in similar manner its bottom end is connected to the jacket 3 by means of a tapering portion 11 made of flexible material.

As can be seen in FIG. 4, the portion 11 is fixed at its bottom end to the jacket 3, e.g. by adhesive, and it is fixed via a top margin to the inner skin 101. As can be seen in FIG. 5, the portion 10 is fixed via a bottom margin to the inner skin 101, and at its top end it is fixed to the sleeve 22.

The tube 2 passes right through the preform 1 and its bottom end opens out into the jacket 3. The jacket comprises a body 30 that is generally cylindrical in shape having a top end 31 which is fixed to the portion 11 as already mentioned, and a bottom end 32 which carries the closure member 4.

The end of the tube 2 is received coaxially in a bore provided in the distributor jacket 3, and it is fixed by appropriate means (not shown). The tube 2 opens out into a "main" pressure chamber 83 which itself opens out via an axial channel 830 into a "secondary" pressure chamber 8 of cylindrical shape. The inlet to the channel 830 is chamfered, constituting a frustoconical seat 84. The chamber 8 which is coaxial with the body 30 acts as a cylinder in which there slides a piston 5. The piston 5 has a head with a compression spring 54 acting thereagainst and urging it upwards, and it also has a tail 500 of smaller diameter that penetrates into an auxiliary chamber 80. The space beneath the head of the piston communicates with the outside via a pressure-balancing channel 850.

Figure 2:
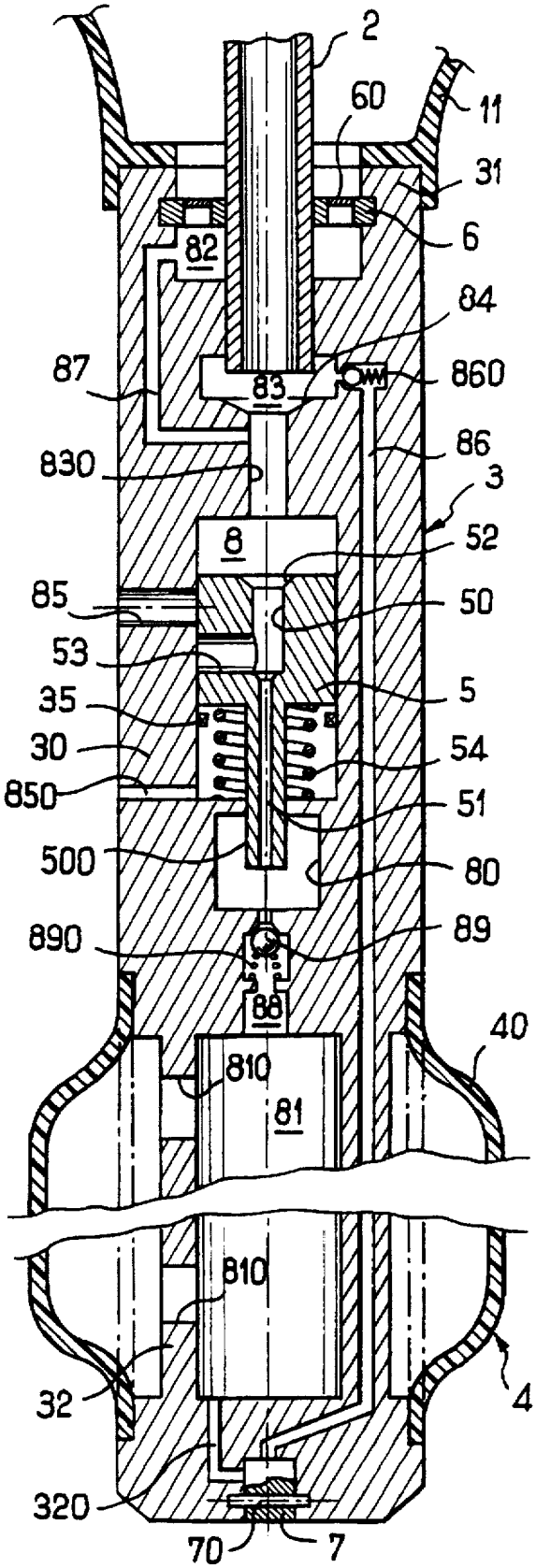
FIG. 2 is a longitudinal section view through the distributor jacket and the hydraulic closure member.

Via a non-return valve constituted by a ball 89 loaded by a spring 890, the chamber 80 communicates with a bore 88 which opens out into a chamber 81 corresponding to the space inside the closure member 4. Via appropriate openings 810, the space 81 communicates with an annular space against the inside wall of the membrane 40 that constitutes the closure member 4. The membrane 40 is made of an elastically deformable material such as an elastomer. It is in the form of a sleeve that is normally cylindrical, and that is fixed via end margins to the body 30, e.g. by crimping. When subjected to internal pressure, the closure member inflates radially as shown in FIG. 2. The outline of the membrane when not inflated is also shown in FIG. 2 using chain-dotted lines.

Figures 6, 6A, 6B, 6C:
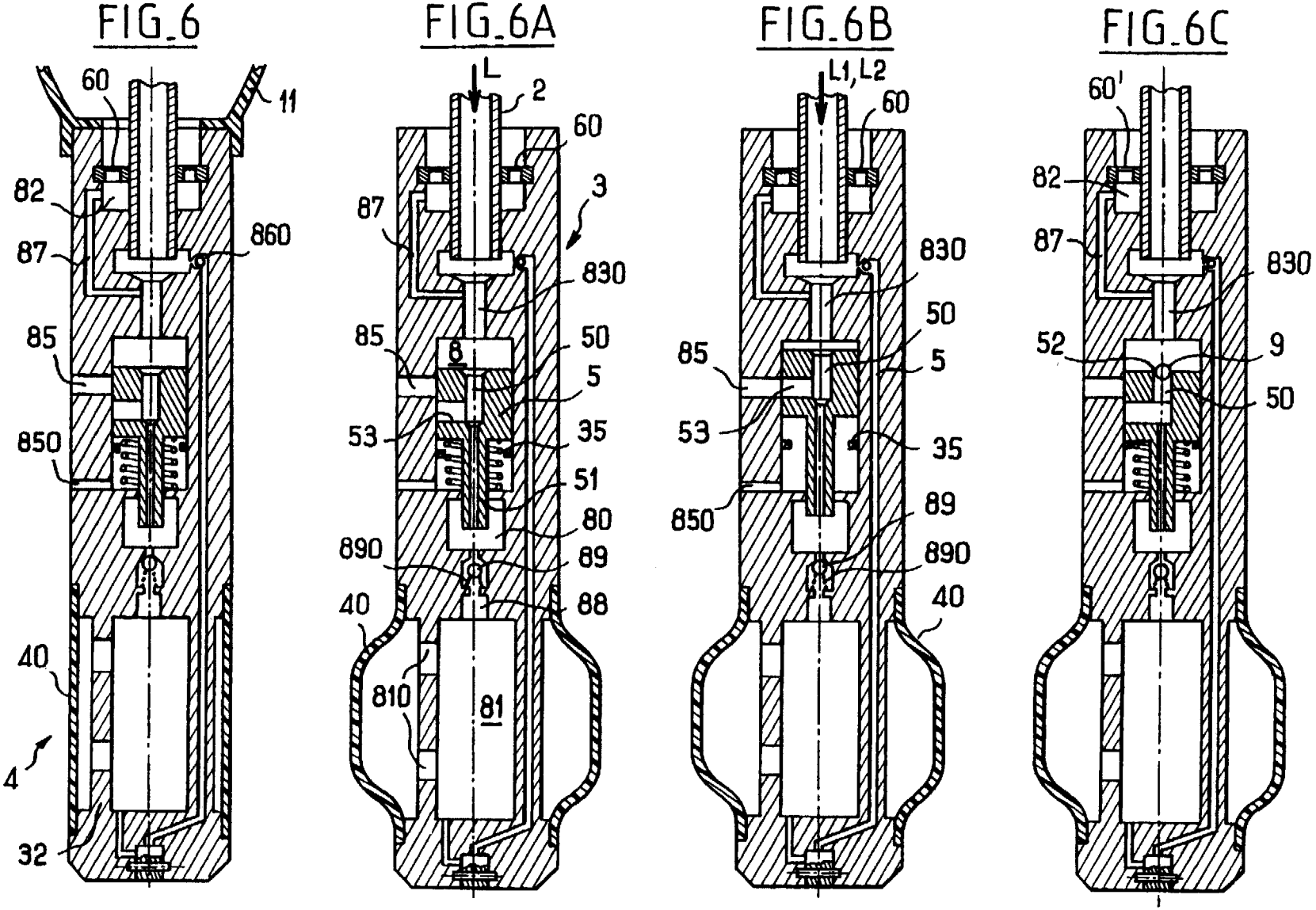

The piston 5 has a central bore passing coaxially therethrough and comprising an upper portion 50 of large diameter and a lower portion 51 of smaller diameter. In the upper portion, the bore 50 opens out into the chamber 8 via a flared chamfered portion 52. The head of the piston 5 is also pierced by a radial bore 53 which puts the bore 50 into communication with the outside. When the piston 5 is in its bottom-most position, it bears against an annular abutment 35. When it is in its high position, the bore 53 comes into correspondence with a bore 85 in the body 30, and likewise disposed radially. Thus, in this high position, as shown in FIG. 6B, the bore 50 communicates with the outside via the radial bores 53 and 85.

A plurality of radial bores 53 that are uniformly spaced apart angularly may be provided, for example there may be three bores at 120° intervals, with a corresponding number of bores 85 being provided through the body 30.

The top portion 31 of the Jacket 3 contains a bore 82 surrounding the tube 2. This bore receives an annular assembly piece 6 having a "frangible" thin membrane 60 mounted therein, which membrane has calibrated breaking strength. In a variant, it could be replaced by a valve having a shear pin.

The frangible membrane 60 defines a pressure chamber 82 surrounding the tube 2 and communicating with the channel 830 via a channel 87. At the bottom end 32 of the jacket 3 there is provided a closure plug 7, e.g. a cylindrical plug, received in a bore of complementary shape. The plug 7 is retained in its housing by a shear pin 70 whose breaking strength is likewise calibrated. The bore which is closed by the plug 7 communicates via a channel 320 with the chamber 81 inside the inflatable closure member 4. The base of the plug 7 looks into a channel 86 which communicates with the pressure chamber 83.

A ball valve 860 is mounted at the inlet to the channel 86 and it is rated so as to prevent fluid from penetrating therein unless the pressure exceeds a certain value, slightly below the value which would cause the pin 70 to shear. Because of this valve, fluid can penetrate into the channel 86 only at the end of the cycle.

The device also includes a locking system (not shown) for locking the piston 5 in its low position. This system, which may be of a type known per se, e.g. a pivoting pawl system, is organized so that the piston 5 normally occupies a position close to its bottom-most position, preventing thrust from the spring 54 causing it to rise. Nevertheless, this locking system is automatically rendered inoperative after a small downwards pulse has been given thereto by the piston 5.

Reference is now made more particularly to FIGS. 3, 3A to 3E, 6, and 6A to 6E, for explaining how the above-described device can be used in cementing casing starting with the preform 1 in the well P.

Figures 3, 3A, 3B, 3C:
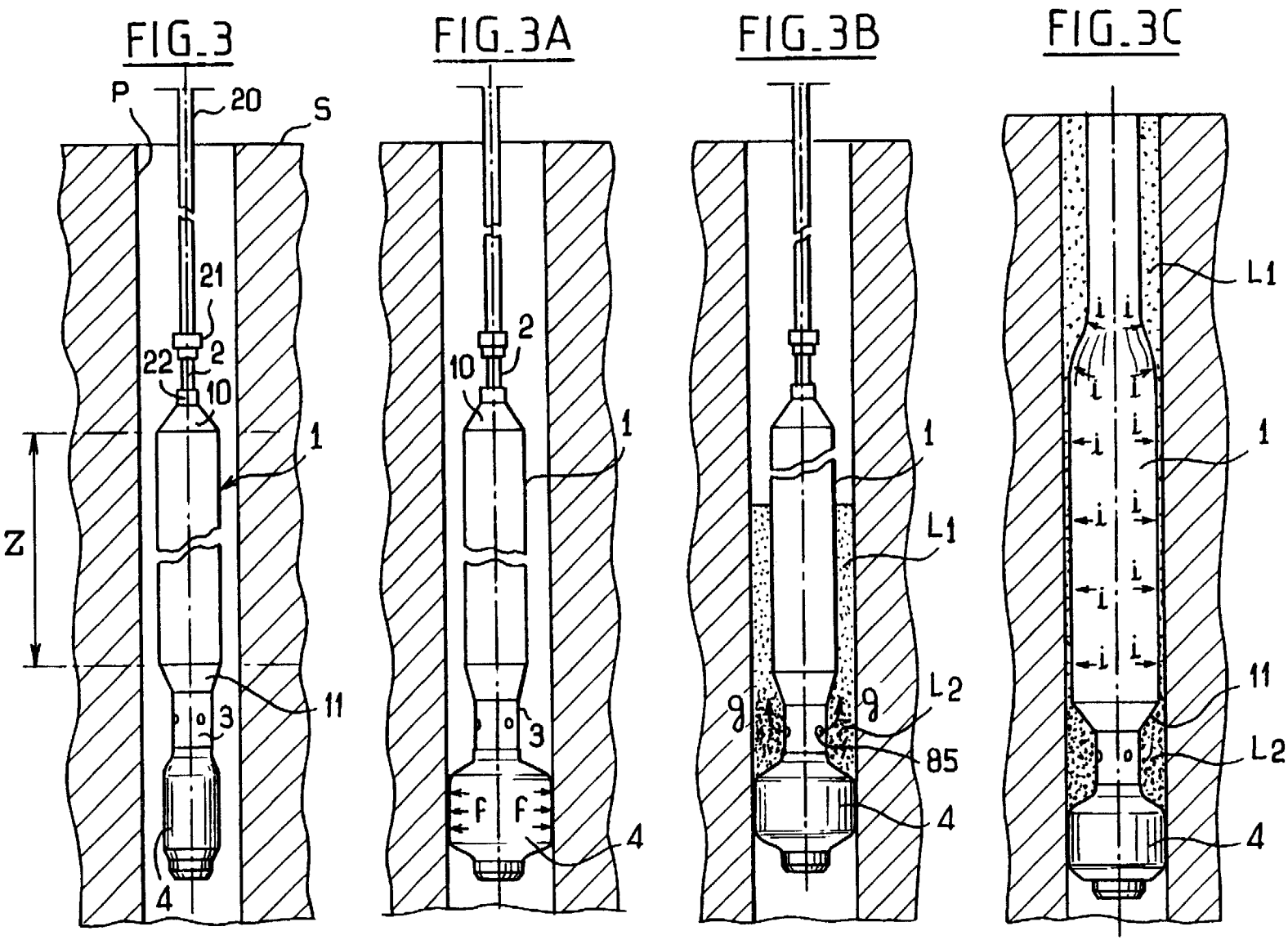
FIGS. 3, 3A, 3B, 3C, 3D, and 3E are diagrammatic overall views analogous to FIG. 1 and on a smaller scale, showing the various main steps in the operation of cementing the casing inside the well.

As shown in FIG. 3, the preform is initially lowered down the well by means of the pipework 20, to a desired depth so that it is level with the zone Z where it is to be fixed.

The closure member 4 is then inflated as symbolized by arrows f in FIG. 3A.

The closure member is inflated from the surface S by injecting fluid L into the pipework 20 and then the tube 2.

The fluid L is a liquid, e.g. water or an ethylene-glycol mixture under pressure, and it is injected into the pipework by means of a high pressure fluid flow pump. As mentioned above, appropriate locking means hold the piston 5 in its low position almost bearing against the abutment 35.

The pressurized fluid L penetrates into the pressure chamber 83, the channel 830, the auxiliary chamber 8, and passes through the piston to reach the auxiliary chamber 80. Because of its pressure, the fluid pushes the ball 89 of the non-return valve and it penetrates into the space 81 inside the closure member, thereby inflating it. The membrane 40 therefore comes to bear intimately against the wall of the well, closing it in sealed manner at the bottom of the preform. Above a certain pressure, e.g. 40 bars, the fluid L is no longer pumped. Because of the non-return valve, the fluid under pressure is retained inside the balloon now that it has been inflated.

During the pressure rise observed while inflating the balloon, e.g. from 20 bars to 30 bars, it is also observed that a downwardly directed force is applied to the piston 5 which has the effect of causing it to slide a very short way downwards, thereby releasing its locking system. Once released in this way, the piston is free to rise fully under thrust from the spring 54 once the fluid L ceases to be pumped. This gives rise to the configuration shown in FIG. 6B where the channel 53 has come into coincidence with the opening 85.

From the surface, cement L1 is then sent down the tube 2. This cement is injected from the periphery of the distributor jacket 3 above the inflated balloon 4 via the opening (or openings) 85.

The necessary quantity of cement has previously been established as a volume that corresponds substantially to the volume of the annular space between the casing (after the preform has been expanded) and the wall of the well over the entire length of the casing. This volume naturally depends on the length of the casing, on the relative diameters of the well and the casing, and on surface irregularities in the wall of the well. Naturally, if certain non-uniformities in the wall are of large extent, then they need to be taken into account when determining the volume of cement to be injected.

The cement L1 is of known kind and is suitable for properly fixing the casing to the wall of the well, e.g. being a settable resin.

The cement L1 injected in this way surrounds the bottom portion of the preform 1 up to a certain height.

In the same way, there is then injected another fluid L2 referred to as the "flush fluid". It may be constituted, for example, by mud of greater density than the cement and of a kind such that it does not mix easily with the cement. The fluid L2 reaches the bottom of the preform by passing through the openings 85 (arrows g, FIG. 3B) and it occupies the annular space situated above the closure member 4 (still inflated). Its volume is determined in such a manner as to cause it to expel all of the cement L1 in an upwards direction relative to the preform.

After the flush fluid L2 has been injected, a small diameter ball 9 is sent from the surface down the pipework 20 so as to pass into the tube 2 together with the fluid L2.

The diameter of the ball (referenced 9 in FIG. 6C) is greater than the diameter of the bore 50, but smaller than the diameter of the bore 830. It thus passes through it and bears against the tapering seat 52 forming a chamfered inlet to the channel 50. Since the fluid can no longer penetrate into the piston, it applies thrust thereto causing it to slide downwards. The piston moves down until it reaches its bottom abutment 35, thereby actuating the trigger of the locking system which then locks automatically in the low position, thus shutting off communication with the opening 85. Thereafter, still from the surface, a fluid L3 is injected via the pipework 20 for the purpose of expanding and polymerizing the preform. By way of example, the fluid L3 may be water carrying a filler of solid particles (densifying agent) giving it a density that is greater than that of the fluids L1 and L2. It is heated so that it reaches the jacket 3 at a temperature of about 130° C., suitable for causing the resin of the preform to polymerize. It is injected at a pressure of about 60 bars, which is sufficient to break the membrane 60. Thus, the liquid is injected into the preform via the channel 87, the chamber 82, and the space 60' previously occupied by the membrane (see FIG. 6C). This causes the preform to be inflated progressively so that it expands radially starting at the bottom and moving upwards given that the density of the internal fluid L3 is greater than that of the external fluids L2 and L1. This progressive expansion as symbolized by arrows i in FIG. 3C causes the cement L1 to be uniformly pushed upwards along the entire length of the preform. In its unfolded state, the preform takes up a cylindrical shape constituting the casing given reference 1'. This casing is uniformly covered in cement. It will be understood that because the cement is pushed back progressively in this way, it occupies the entire outside surface of the casing even if the through passage for the cement is small or even non-existent in some places.

Thereafter, the heated and pressurized fluid L3 is caused to circulate inside the preform—now the casing—for the time required to cause its wall to polymerize, which time is generally a few hours. Simultaneously, the cement sets.

The fluid used for polymerization purposes is not necessarily the same as that used for progressively inflating the preform, since once the preform has expanded, the density of the fluid inside it is no longer important. Its function is merely to cause the wall to polymerize.

It should be observed that it is also generally difficult to determine the exact volume of cement required. It is therefore prudent to inject a volume of cement that is a little greater than the calculated volume so as to prevent the top portions of the casing having insufficient cementing.

Under such circumstances, it is important that any excess cement is destroyed so that it does not set on top of the casing. This problem can be solved by the discharge valve 23 provided above the top end of the preform. After the preform has been inflated, the resulting pressure rise inside the preform and inside the tube 2 causes excess liquid L to escape from the preform via the valve 23, as illustrated in FIG. 3D by arrows h. This liquid removes any excess cement that is to be found at this level. This ensures that cementing takes place only level with the casing.

At the end of the operation, a second ball, given reference 9' in FIG. 6D, is sent down the tube 2. It has a diameter such as to allow it to pass along the tube 2 but not through the bore 830. The ball 9' consequently bears against the chamfered seat 84 at the inlet to the bore 830. The pressure of the fluid L3 is then increased so as to exceed the rated value of the valve 860. This pressure is transmitted via the channel 86 to the closure plug 7. This pressure is relatively high, e.g. about 100 bars, and it is sufficient to cause the pin 70 to shear. The plug 7 is consequently expelled, as shown in FIG. 6E, such that the liquid which was previously held captive inside the closure member 8 is free to escape towards the bottom of the well via the channel 320. The closure member deflates as represented by arrows j in FIG. 3E, and the fluid L2 which used to be above the closure member also drops to the bottom of the well.

Thereafter, the device should be removed from the well. For this purpose, upwards traction is applied on the pipework 20, as represented by arrow K in FIGS. 3E, 4, and 5.

Because of this traction, the portion 10 detaches from the inside skin 101 of the casing (see FIG. 5).

At the bottom end, the portion 11 turns insideout and removes the inside skin 101 likewise by turning it insideout (see FIG. 4A where this turning insideout is represented by arrows r).

The inside skin 101 is thus progressively and completely peeled off as the device is removed.

At the end of this operation, the cemented casing remains in place minus its inside skin.

Naturally, the above-described cycle may be repeated in order to cement a plurality of lengths of casing end-to-end.

Figure 7:
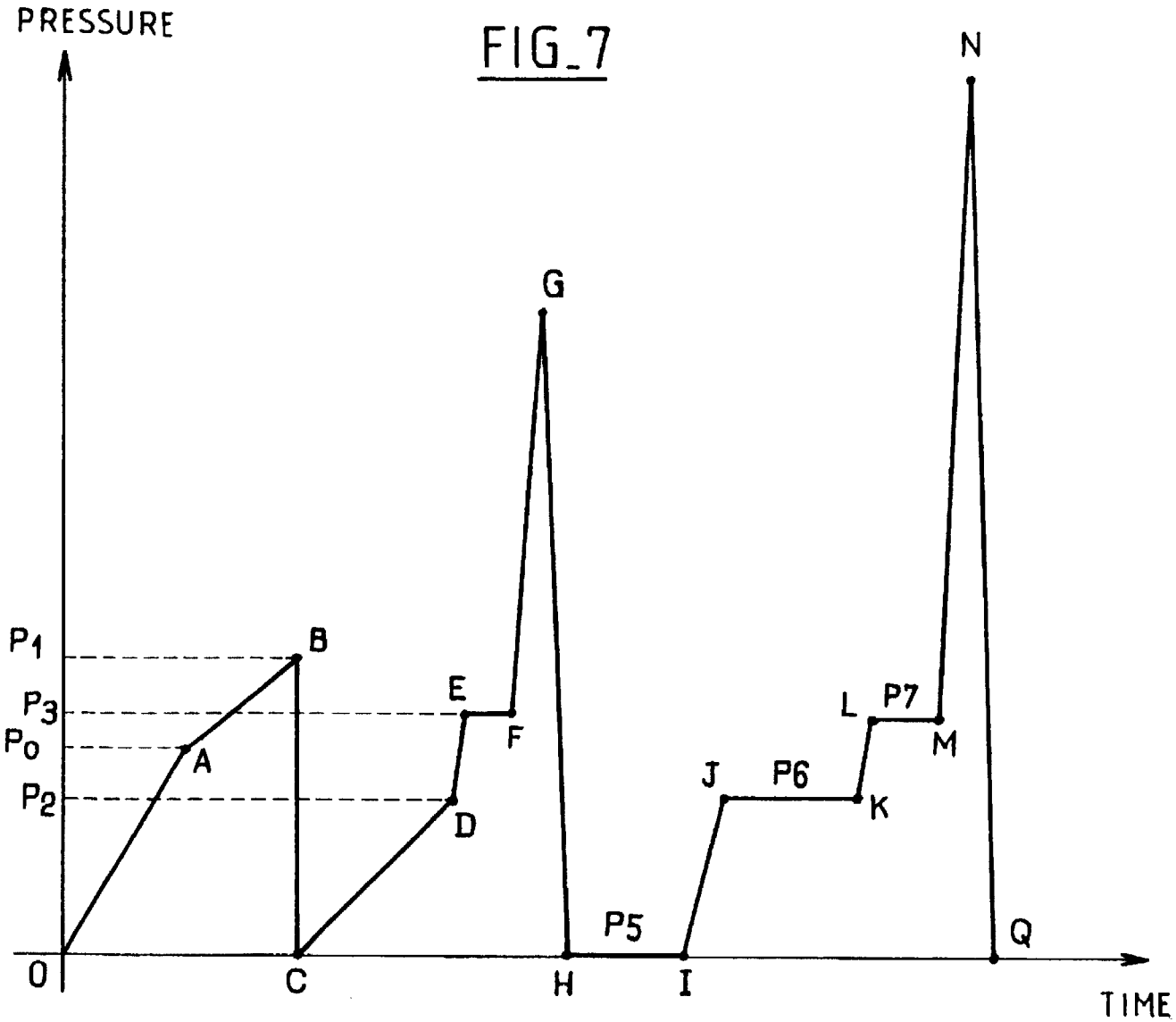
FIG. 7 is a graph showing the values of the pressures involved as a function of time during the operation.

The graph of FIG. 7 is a diagram showing how the pressures implemented during the operation vary.

Rectilinear curve portion OA represents the initial rise in pressure while the hydraulic closure member is being inflated up to a pressure $P_0$, which is equal to about 30 bars, for example.

Curve length AB corresponds to the end of the closure member being inflated up to a pressure $P_1$ (about 35 bars); during this stage, the pressure exerted on the piston head causes it to move downwards, thereby releasing its locking mechanism. Curve portion BC corresponds to injection being stopped and to the piston rising upwards (under thrust from the spring 54), thereby progressively opening the openings 85.

Until this point, the fluid being injected is the fluid L.

Stage CD corresponds to successively injecting the cement L1 and the flush fluid L2.

Point E corresponds to the sudden rise in pressure when the ball 9 that is pumped down after the flush fluid reaches its seat 52, thereby closing the internal channel 50/51 of the piston.

Curve portion EF corresponds to pumping coming to an end while the pressure remains constant. Stage FG represents the rise in pressure up to the breaking pressure $P_4$ of the device that enables fluid to flow inside the preform. By way of example, $P_4$=60 bars.

Stage GH corresponds to the sudden drop in pressure that results from fluid flow into the preform being opened up.

Stage HI corresponds to the preform being inflated by means of the fluid L3 (pressure $P_5$). Once inflation has taken place, the pressure increases, which corresponds to segment IJ, until it reaches the pressure that is controlled by the valve 23. Stage JK corresponds to the preform polymerizing. The pressure $P_6$ then extending inside the preform is substantially constant since it is controlled by the valve 23. By way of example, $P_6$=20 bars. Point L corresponds to the ball 9' becoming seated. Curve portion LM corresponds to pumping being stopped, so that the pressure ($P_7$) remains constant. Thereafter, pumping is restarted giving rise to a very considerable increase in pressure corresponding to segment MN. Pressure $P_8$, e.g. about 100 bars, is sufficient to shear the pin 70, thereby causing the hydraulic closure member to deflate immediately, which corresponds to the rapid drop in pressure of segment NQ.

We claim:

1. A method of cementing casing inside a borehole or a conduit that is approximately cylindrical, using a tubular preform that is deformable by being expanded radially from a folded first state in which its maximum transverse dimension is considerably smaller than the diameter of the well or conduit, to an unfolded second state in which it is cylindrical in shape and has a diameter that is slightly smaller than that of the well or the conduit, the preform being settable on site in order to constitute the casing, the method comprising steps of:

a) inserting the preform (1) in the folded state into the well or into the conduit (P), and lowering said preform down to the desired level;

b) closing the well or the conduit (P) at the bottom of the preform (1) by substantially inflating in said zone a hydraulically deformable closure member (4);

c) injecting a cement (L1) that is fluid and settable above the closure member (4) so as to surround the bottom portion of the preform, with the volume of said cement (L1) corresponding substantially to the volume required for cementing the casing in the well or in the conduit;

d) deforming the preform (1) to cause it to take up its unfolded state, said deformation taking place progressively from the bottom upwards, so that the cement is displaced little by little along the annular space between the preform (1) and the wall of the well or of the conduit, along the entire height of the preform;

e) allowing the preform (1) to set to obtain the casing (1'), and allowing the cement (L1) to set; and f) deflating the closure member and then withdrawing the closure member (4) from the well or the conduit.

2. The method of claim 1, wherein said closure member (4) is inflated from the surface by means of a hydraulic fluid which is delivered by a tube (2) that passes longitudinally right through the preform (1).

3. The method of claim 2, wherein after the step of injecting the cement (L1), the method further comprises the step of injecting a non-setting flush fluid (L2) of density greater than that of the cement so as to occupy the space extending between the closure member (4) and the bottom end of the preform (1).

4. The method of claim 2 or 3, wherein the cement (L1) and optionally the flush fluid (L2) are delivered from the surface via the same tube (2) as is used for inflating the closure member (4), passing via a distributor jacket (3) mounted at the end of the tube (2) which carries said closure member (4).

5. The method of claim 4, wherein the step of allowing the preform to set is implemented using a preform (1) having a wall that sets by polymerizing when heat is applied thereto, the method step further including causing the preform to expand radially and to set by means of a hot fluid which is delivered from the surface via said tube (2), and via said distributor jacket (3).

6. The method of claim 1, wherein after the step of deforming the preform, the method further comprises the step of injecting a third fluid (L3) into the zone situated above the top end of the preform (1) to eliminate any excess cement that may be present in said zone.

* * * * *

UNITED STATES PATENT AND TRADEMARK OFFICE

CERTIFICATE OF CORRECTION

PATENT NO. : 5,718,288

DATED : February 17, 1998

INVENTOR(S) : Bertet et al.

It is certified that error appears in the above-identified patent and that said Letters Patent is hereby corrected as shown below:

In the title page, item [57] Abstract, please delete " from the top towards the bottom ", and insert -- from the bottom towards the top --.

Signed and Sealed this

Ninth Day of March, 1999

*Attest:*

Q. TODD DICKINSON

*Attesting Officer*

*Acting Commissioner of Patents and Trademarks*